US007865100B2

(12) United States Patent
Yamanaka et al.

(10) Patent No.: US 7,865,100 B2
(45) Date of Patent: Jan. 4, 2011

(54) FIXING APPARATUS AND IMAGE FORMING APPARATUS

(75) Inventors: Takashi Yamanaka, Nara (JP); Kimihide Tsukamoto, Osaka (JP); Tatsuya Shinkawa, Nara (JP); Kan Mukai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 434 days.

(21) Appl. No.: 12/046,580

(22) Filed: Mar. 12, 2008

(65) Prior Publication Data

US 2008/0226325 A1 Sep. 18, 2008

(30) Foreign Application Priority Data

Mar. 14, 2007 (JP) ..... 2007-065509

(51) Int. Cl.
*G03G 15/20* (2006.01)

(52) U.S. Cl. ..... 399/69; 399/323

(58) Field of Classification Search ..... 399/69, 399/122, 322, 323
See application file for complete search history.

(56) References Cited

U.S. PATENT DOCUMENTS 5,406,363 A * 4/1995 Siegel et al. ..... 399/323
5,802,434 A * 9/1998 Takehara et al. ..... 399/323
6,078,760 A * 6/2000 Abe et al. ..... 399/45
7,551,883 B2 * 6/2009 Ide et al. ..... 399/323
2002/0164172 A1 * 11/2002 Tsubaki et al. ..... 399/45
2003/0147663 A1 * 8/2003 Fukutome ..... 399/69

FOREIGN PATENT DOCUMENTS

JP 01-288887 11/1989
JP 2004-279927 10/2004
JP 2005-010218 1/2005

OTHER PUBLICATIONS

Machine translation of Oikawa (Pub No. JP 2005-010218) Pub date Jan. 13, 2005.*

* cited by examiner

*Primary Examiner*—David M Gray
*Assistant Examiner*—Rodney Bonnette
(74) *Attorney, Agent, or Firm*—Renner, Otto, Boisselle & Sklar, LLP

(57) ABSTRACT

A paper separation claw is separated from a surface of a pressure roller by a drive source being turned ON at a time t2 before commencement of rotation of the pressure roller, and the paper separation claw is made to contact the surface of the pressure roller by the drive source being turned OFF after commencement of rotation (a time t4) of the pressure roller. Furthermore, the paper separation claw is separated from the surface of the pressure roller by the drive source being turned ON again before stopping of rotation (a time t5) of the pressure roller after an image forming operation of a single job is finished, and the paper separation claw is made to contact the surface of the pressure roller by the drive source being turned OFF again after stopping of rotation (a time t8) of the pressure roller.

11 Claims, 6 Drawing Sheets temperature control means
ON
OFF
(heater ON/OFF control)

motor 244
(for driving the hot roller 35 and the pressure roller 36)
stop
rotation
stop drive source 220
(for driving the separation claw 72)
ON
OFF
contact
separation
contact
separation
contact
t1
t6
T11
T21
T41
t1 t2 t3 t4
t5 t7 t8
T1
T2
T3
T4
T5

FIXING APPARATUS AND IMAGE FORMING APPARATUS

CROSS-REFERENCE TO RELATED APPLICATION

This application claims priority under 35 U.S.C. §119(a) on Patent Application No. 2007-065509 filed in Japan on Mar. 14, 2007, the entire contents of which are herein incorporated by reference.

BACKGROUND OF THE INVENTION

1. Field of the Invention

The present invention relates to fixing apparatuses provided with a paper separation member that is arranged so as to be capable of contacting and separating from a surface of a fixing roller in order to separate from the fixing roller a paper to be transported, and more specifically relates to fixing apparatuses in which toner that has collected between the paper separation member and the fixing roller is removed by an action of the paper separation member, and image forming apparatuses equipped with these fixing apparatuses 2. Description of the Related Art Conventional fixing apparatuses and image forming apparatuses equipped with these are provided with a paper separation member that contacts the surface of the fixing roller in order to separate from the fixing roller a paper to be transported. And among these image forming apparatuses, some have been proposed (see JP 2004-279927A for example) in which the paper separation member is configured so as to be capable of contacting and separating from the surface of the fixing roller. With the image forming apparatus described in JP 2004-279927A, by keeping the paper separation member separate from the surface of the fixing roller at times other than during an image forming operation, the contact time between the paper separation member and the surface of the fixing roller can be shortened as much as possible, which prevents the paper separation member from damaging the surface of the fixing roller.

In this regard, there has been a problem in fixing apparatuses provided with these paper separation members in that toner (hereinafter also referred to as "residual toner") that has collected between the paper separation member and the fixing roller (particularly the pressure roller) re-adheres to the fixing roller when the fixing roller commences rotation, thereby undesirably soiling the paper that is transported in.

That is, in a case where toner is residual between the paper separation member and the fixing roller during the image forming operation, the residual toner hardens when image forming stops temporarily in this state. Then, at the time of the next image forming operation, the residual toner melts on the surface of the fixing roller due to the heat of the fixing roller, thereby soiling the paper that is transported in. In particular, from a perspective of device miniaturization and power saving in regard to the pressure roller, in a case where no cleaning member is provided or where there is only a metal roller that is idly rotated by the pressure roller, there is no sufficient cleaning capability such as that of a cleaning unit using a web sheet provided for the hot roller in the case of the metal roller. For this reason, this is a structure in which toner that could not be sufficiently removed by the metal roller tends to readily adhere between the paper separation member and the pressure roller during image forming operations.

SUMMARY OF THE INVENTION

An object of the present invention is to provide a fixing apparatus capable of very reliably removing toner that has collected between the paper separation member and the fixing roller, and an image forming apparatus equipped with this fixing apparatus.

A fixing apparatus according to the present invention is provided with a pair of fixing rollers, a fixing roller drive source for rotationally driving the fixing rollers, a paper separation member arranged so as to be capable of contacting and separating from a surface of one of the fixing rollers in order to separate from the fixing roller a paper transported along with rotation of the fixing roller while contacting the surface of the fixing roller, a separation member drive source for driving the paper separation member, and a control portion for controlling a fixing process, wherein the control portion performs control so that the paper separation member separates from the surface of the fixing roller by performing drive control on the separation member drive source before a change in a drive state of the fixing rollers by the fixing roller drive source, and the paper separation member contacts the surface of the fixing roller by performing drive control on the separation member drive source after a change in the drive state of the fixing rollers by the fixing roller drive source.

Furthermore, the fixing apparatus according to the present invention may be further provided with a temperature detection portion for detecting a temperature of the surface of the fixing roller, and a heating portion for heating the fixing roller, wherein the control portion executes temperature control on the fixing roller using the heating portion based on a temperature detected by the temperature detection portion in a period in which the paper separation member is in contact with the fixing roller, and carries out separation control of the paper separation member during execution of this temperature control. It should be noted that the paper separation member is a paper separation claw and it is preferable that a portion of the paper separation claw that contacts the surface of the fixing roller is formed in a sharp shape having a cross-sectional wedge shape.

More specifically, the control portion may perform control so as to cause the paper separation claw to separate from the surface of the fixing roller before commencement of rotation of the fixing roller, and cause the paper separation claw to contact the surface of the fixing roller after commencement of rotation of the fixing roller.

That is, by commencing temperature control of the surface of the fixing roller using the temperature diction portion (for example, a thermistor) and the heating portion (for example, a heater), the adhesion of the toner to the fixing roller can be weakened by heat from the surface of the fixing roller. In this way, toner that is residual between the paper separation claw and the fixing roller adheres to the paper separation claw side, which has a lower temperature than the fixing roller. And by separating the paper separation claw from the fixing roller before commencement of rotation of the fixing roller in this state, a major portion of toner adhering to the paper separation claw drops due to the vibration at the time of separation. After this, due to vibration caused by contact when the paper separation claw contacts the surface of the fixing roller and a rubbing effect due to rotation of the fixing roller, the toner remaining on the paper separation claw is scraped off so as to drop.

In this way, in a case where the fixing roller is a pressure roller for example, the toner adhering between the pressure roller and the paper separation claw is removed at the point in time of commencement of the next image forming operation, which makes it possible to prevent back face smearing of the paper that is transported in.

Furthermore, the control portion may perform control so as to cause the paper separation claw to separate from the surface of the fixing roller before stopping of rotation of the fixing roller, and cause the paper separation claw to contact the surface of the fixing roller after stopping of rotation of the fixing roller.

That is, before stopping rotation of the fixing roller, the surface temperature of the fixing roller is comparatively high such that the adhesion of toner to the surface of the fixing roller is weak. Consequently, by separating the paper separation claw in this state, thermal conduction to the paper separation claw is interrupted, and therefore toner adhering to the paper separation claw can be cooled. In this way, the residual toner adhering to the paper separation claw tends not to melt even though the paper separation claw is made to contact the fixing roller again after stopping the rotation of the fixing roller, and therefore the residual toner can be prevented from re-adhering to the surface of the fixing roller.

In this way, with a configuration in which separation and contact operations of the paper separation claw are controlled so toner that has collected between the paper separation claw and the fixing roller adheres to the paper separation claw side, and in which toner that has adhered to the paper separation claw is caused to drop due to vibration caused by separation as well as vibration and a rubbing effect caused by contact with the surface of the fixing roller, it is possible to prevent the toner from remaining on the surface of the fixing roller and thus smearing the paper. Incidentally, in regard to the paper separation claw, the main body portion of the separation claw is formed using a super engineering plastic such as PEEK (polyether ether ketone) or PI (polyimide), and the leading edge of the separation claw has undergone surface treatment with a fluorocarbon resin such as PTFE (polytetrafluoroethylene) or PFA (a copolymer of tetrafluoroethylene and perfluoroalkyl vinyl ether). Note however that this is one example and there is no limitation to a configuration of these materials.

Here, the pair of fixing rollers may be constituted by a hot roller and a pressure roller, and the control portion may perform separation and contact control as described above on the paper separation claw member provided for the pressure roller. As mentioned earlier, in many cases the pressure roller either is not provided with a cleaning member or is provided with only a metal roller, and therefore by applying the present invention to the pressure roller, a much better toner removal effect can be obtained. Note however that in models in which only a metal roller is provided for the hot roller and not a cleaning unit as a cleaning member, a much better toner removal effect can be obtained by applying the present invention to the hot roller.

Furthermore, in a configuration in which the heating portion is provided both inside the hot roller and inside the pressure roller, and the temperature detection portion detects the temperature of the surface of the hot roller, the control portion may be configured to control energization of the heating portion inside the pressure roller based on a detection result of the temperature detection portion. In this way, the adhesion of toner to the pressure roller surface can be weakened more quickly by providing a heating portion inside the pressure roller also that contacts the paper separation claw, and therefore toner that is residual between the paper separation claw and the pressure roller can be made to more reliably adhere to the paper separation claw side. That is, residual toner can be made more easily removable from the pressure roller surface. Furthermore, by using the detection results of the temperature detection portion, which detects the temperature of the surface of the hot roller (that is, by making joint use of the temperature detection portion), for controlling the surface temperature of the pressure roller, the number of components can be reduced and device miniaturization becomes possible.

On the other hand, the separation member drive source may be configured so that the paper separation claw is driven so as to separate from the surface of the fixing roller when in an energized state, and the paper separation claw is driven so as to contact the surface of the fixing roller when in a non-energized state, and the control portion may be configured to control the separation member drive source to a non-energized state when the paper separation claw is to be caused to contact the surface of the fixing roller, and control the separation member drive source to an energized state when the paper separation claw is to be caused to separate from the surface of the fixing roller. For example, in a case where energization of the solenoid for example, which is a drive source of the separation claw drive mechanism, is always on in order to continuously maintain a state of connection of the paper separation claw to the surface of the fixing roller during image forming operations, the power consumption increases greatly and problems occur involving component deterioration and heat produced by the solenoid, and therefore a technique is called for to reduce the energization time to the solenoid. Accordingly, by using a configuration in which the paper separation claw is made to separate when the solenoid is energized, the energization time to the solenoid can be reduced, thereby enabling effects of power saving, increased life, and less heat produced.

Furthermore, by equipping this fixing apparatus in an image forming apparatus, it is possible to provide an image forming apparatus having high image quality with little paper smearing.

DESCRIPTION OF THE PREFERRED EMBODIMENTS

Hereinafter, an embodiment of the present invention is described in detail with reference to the accompanying drawings.

—Overall Description of Image Forming Apparatus—

Figure 1:
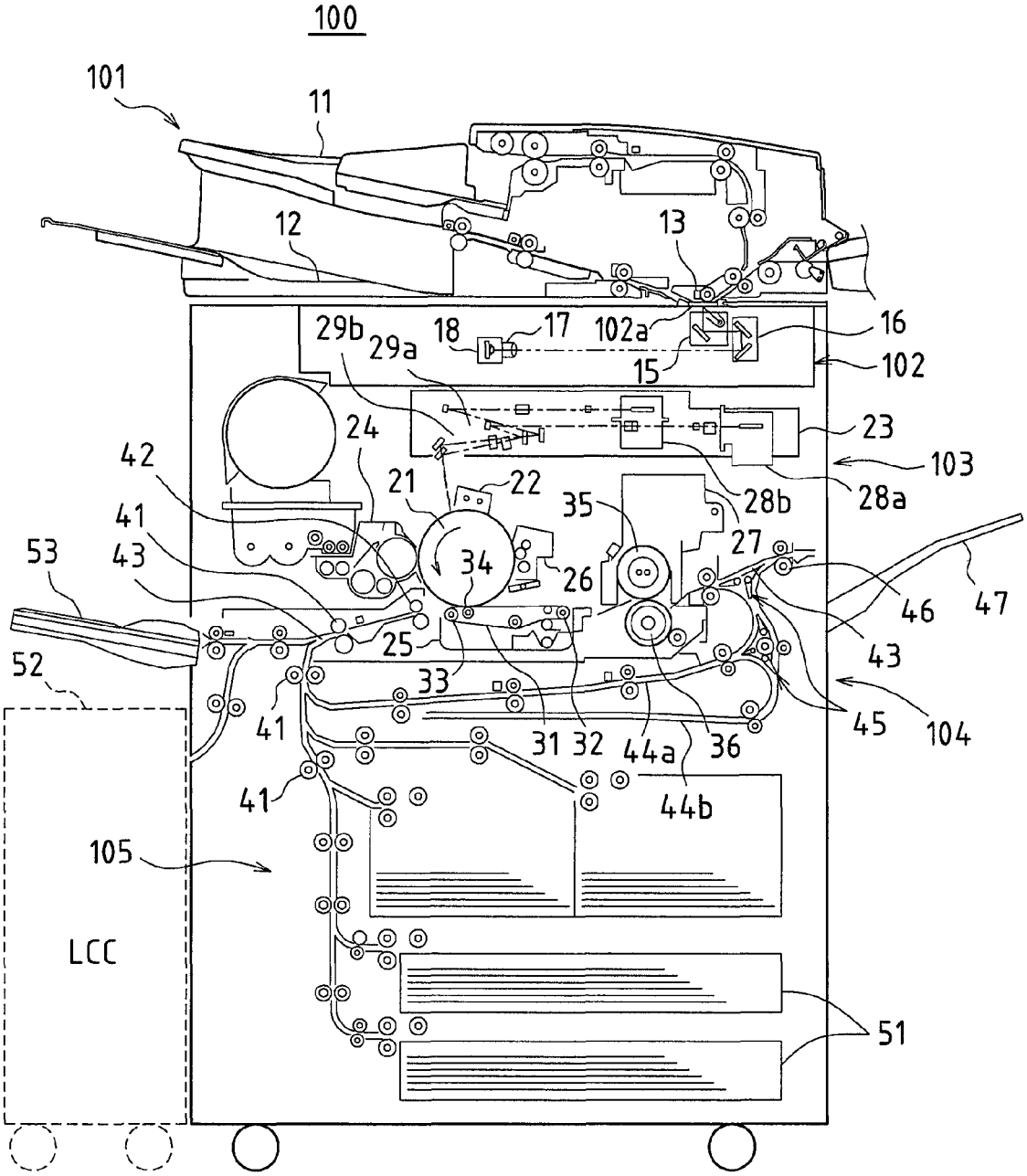
FIG. 1 is a schematic view of an image forming apparatus in which one embodiment of a fixing apparatus according to the present invention has been applied.

FIG. 1 is a schematic view of an image forming apparatus in which one embodiment of a fixing apparatus according to the present invention has been applied.

The image forming apparatus 100 obtains image data that has been read from an original paper or received from outside, and forms a monochrome image indicated by the image data on a recording paper, and its structure can be broadly divided into an original paper transport portion (ADF) 101, an image reading portion 102, a print portion 103, a recording paper transport portion 104, and a paper feed portion 105.

When at least one sheet of an original paper is set in an original setting tray 11 in the original paper transport portion 101, the original paper is withdrawn and transported from the original setting tray 11 sheet by sheet, and the original paper is guided to and made to pass through an original reading window 102*a* of the image reading portion 102, then the original paper is discharged to a discharge tray 12.

A CIS (contact image sensor) 13 is arranged above the original reading window 102*a*. When the original paper passes over the original reading window 102*a*, the CIS 13 repetitively reads in a main scanning direction an image of a back face of the original paper and outputs image data that indicates the image of the back face of the original paper.

Furthermore, when the original paper passes over the original reading window 102*a*, the image reading portion 102 uses a lamp of a first scanning unit 15 to expose the front face of the original paper, then guides reflected light from the front face of the original paper to an imaging lens 17 using mirrors of the first scanning unit 15 and a second scanning unit 16, and an image of the front face of the original paper is imaged onto a CCD (charge coupled device) 18 by the imaging lens 17. The CCD 18 repetitively reads in a main scanning direction an image of the front face of the original paper and outputs image data that indicates the image of the front face of the original paper.

Further still, in a case where the original paper is placed onto a platen glass on an upper surface of the image reading portion 102, the first scanning unit 15 and the second scanning unit 16 are caused to move while maintaining a predetermined velocity relationship such that the front face of the original paper on the platen glass is exposed by the first scanning unit 15 and reflected light from the front face of the original paper is guided to the imaging lens 17 by the first scanning unit 15 and the second scanning unit 16, and an image of the front face of the original paper is imaged onto the CCD 18 by the imaging lens 17.

Image data that has been outputted from the CIS 13 or the CCD 18 undergoes various types of image processing by a control circuit such as a microcomputer and is then outputted to the print portion 103.

The print portion 103 is for recording an original, which is represented by image data, onto paper, and is provided with components such as a photosensitive drum 21, a charging unit 22, an optical writing unit 23, a development unit 24, a transfer unit 25, a cleaning unit 26, and a fixing apparatus 27.

The photosensitive drum 21 rotates in one direction and after its surface is cleaned by the cleaning unit 26, its surface is uniformly charged by the charging unit 22. The charging unit 22 may be a charger type unit or may be a roller type or brush type unit that makes contact with the photosensitive drum 21.

The optical writing unit 23 is a laser scanning unit (LSU) provided with two laser irradiation portions 28*a* and 28*b*, and two mirror groups 29*a* and 29*b*. The optical writing unit 23 receives image data and emits laser beams corresponding to the image data from the laser irradiation portions 28*a* and 28*b* respectively, then these laser beams are irradiated onto the photosensitive drum 21 via the mirror groups 29*a* and 29*b* so that the uniformly charged surface of the photosensitive drum 21 is exposed, thereby forming an electrostatic latent image on the surface of the photosensitive drum 21.

To support high speed print processing, the optical writing unit 23 employs a two-beam system provided with the two laser irradiation portions 28*a* and 28*b* such that the irradiation timing is made faster and the load is decreased.

It should be noted that instead of the laser scanning unit, an EL writing head or an LED writing head in which light-emitting elements are lined up in an array may be used as the optical writing unit 23.

The development unit 24 supplies toner to the surface of the photosensitive drum 21 to develop the electrostatic latent image and form a toner image on the surface of the photosensitive drum 21. The transfer unit 25 transfers the toner image on the surface of the photosensitive drum 21 to the recording paper that has been transported in by the recording paper transport portion 104. The fixing apparatus 27 applies heat and pressure to the recording paper to cause the toner image to fix onto the recording paper. After this, the recording paper is further transported and discharged to a discharge tray 47 by the recording paper transport portion 104. Furthermore, the cleaning unit 26 removes and collects toner that is residual on the surface of the photosensitive drum 21 after development and transfer.

Here, the transfer unit 25 is provided with such components as a transfer belt 31, a drive roller 32, an idler roller 33, and an elastic conductive roller 34, and the transfer belt 31 is caused to rotate while spanning the rollers 32 to 34 and other rollers in a tensioned state. The transfer belt 31 has a predetermined resistance value (for example, $1\times10^{9}$ to $1\times10^{13}$ Ω/cm) and transports recording paper that has been placed on its surface. The elastic conductive roller 34 presses against the surface of the photosensitive drum 21 with interposition of the transfer belt 31 so that the recording paper on the transfer belt 31 presses against the surface of the photosensitive drum 21. An electric field of a polarity opposite to the charge of the toner image on the surface of the photosensitive drum 21 is applied to the elastic conductive roller 34, and the toner image on the surface of the photosensitive drum 21 is transferred to the recording paper on the transfer belt 31 due to the opposite polarity electric field. For example, when the toner image has a charge of a negative (−) polarity, the elastic conductive roller 34 is subjected to an electric field having a positive (+) polarity.

The fixing apparatus 27 is provided with a hot roller 35 and a pressure roller 36. A pressure-applying member not shown in the drawings is arranged at both ends of the pressure roller 36 so that the pressure roller 36 is pressed into contact with the hot roller 35 with a predetermined pressure. When the recording paper is transported to a pressing region (referred to as a fixing nip portion) between the hot roller 35 and the pressure roller 36, the unfixed toner image on the recording paper is subjected to thermal melting and pressure while the recording paper is being transported by the rollers 35 and 36 such that the toner image fixes to the recording paper.

The recording paper transport portion 104 is provided with components such as a plurality of pairs of transport rollers 41 for transporting the recording paper, a pair of registration rollers 42, a transport path 43, reverse transport paths 44*a* and 44*b*, a plurality of branching claws 45, and a pair of discharge rollers 46.

In the transport path 43, the recording paper is taken in from the paper feed portion 105, then the recording paper is transported until the leading edge of the recording paper reaches the registration rollers 42. At this time the registration rollers 42 are being temporarily stopped, and therefore the leading edge of the recording paper reaches and contacts the registration rollers 42 and the recording paper flexes. Due to the elastic force of the flexed recording paper, the leading edge of the recording paper aligns parallel to the registration rollers 42. After this, rotation of the registration rollers 42 commences and the recording paper is transported by the registration rollers 42 to the transfer unit 25 of the print portion 103, then the recording paper is further transported by the discharge rollers 46 to the discharge tray 47.

Stopping and rotation of the registration rollers 42 can be achieved by switching on and off a clutch between the registration rollers 42 and their drive shafts or by switching on and off the motor that is the drive source of the registration rollers 42.

Furthermore, when an image is to be recorded to the back face of the recording paper also, the branching claws 45 are selectively switched so that the recording paper is guided from the transport path 43 into the reverse transport path 44*b*, then transport of the recording paper is caused to stop temporarily, and the branching claws 45 are selectively switched again so that the recording paper is guided from the reverse transport path 44*b* into the reverse transport path 44*a*, and once the back side of the recording paper has been turned over the recording paper returns to the registration rollers 42 of the transport path 43 via the reverse transport path 44*a*.

This manner of transporting the recording paper is referred to as switchback transporting, and switchback transporting allows the back side of the recording paper to be turned over and at the same time switches the leading edge and the trailing edge of the recording paper. Consequently, when the recording paper is turned over and returned, the trailing edge of the recording paper makes contact with the registration rollers 42 such that the trailing edge of the recording paper aligns in parallel to the registration rollers 42, then the recording paper is transported from its trailing edge by the registration rollers 42 to the transfer unit 25 of the print portion 103 and printing is carried out on the back face of the recording paper, then the unfixed toner image on the back face of the recording paper is subjected to thermal melting and pressure by the fixing nip portion between the rollers 35 and 36 of the fixing apparatus 27 such that the toner image fixes onto the back face of the recording paper, after which the recording paper is transported to the discharge tray 47 by the discharge rollers 46.

Sensors that detect the position and the like of the recording paper are arranged in various locations in the transport path 43 and the reverse transport paths 44*a* and 44*b*, and the transport and positioning of the recording paper are carried out by performing drive control on the transport rollers and the registration rollers based on the positions of the recording paper detected by the various sensors.

The paper feed portion 105 is provided with a plurality of paper feed trays 51. Each of the paper feed trays 51 is a tray for storing recording paper and these are provided in a lower portion of the image forming apparatus 100. Furthermore, each of the paper feed trays 51 is provided with a pickup roller or the like for withdrawing the recording paper sheet by sheet and recording paper that has been withdrawn is fed to the transport path 43 of the recording paper transport portion 104.

Since the image forming apparatus 100 is aimed at high speed print processing, each of the paper feed trays 51 has a capacity capable of storing from 500 to 1,500 sheets of standard size recording papers.

Furthermore, at a lateral surface of the image forming apparatus 100 are provided a large capacity cassette (LCC) 52, which makes it possible to store large volumes of multiple types of recording paper, and a manual paper feed tray 53 for feeding recording paper of mainly nonstandard sizes.

The discharge tray 47 is arranged at a lateral surface on an opposite side to the manual paper feed tray 53. Instead of the discharge tray 47, configurations in which post processing devices of discharged paper (stapling, punching and the like) or a plurality of levels of discharge trays are arranged as options are also possible.

In the image forming apparatus 100 as above, the print processing speed is increased to improve the usefulness thereof. For example, when using standard A4 size recording paper, the transport speed of the recording paper is set to 110 sheets/min (a processing speed of 540 mm/sec).

When the transport speed of the recording paper or the processing speed is increased in the fixing apparatus 27, there is a tendency for a sufficient amount of heat to become unable to be applied to the recording paper that passes through the fixing nip portion between the hot roller 35 and the pressure roller 36, and for the surface temperature of the rollers 35 and 36 to drop, and if this is ignored, deficiencies occur in the fixing of the toner image to the recording paper.

For this reason, in the fixing apparatus 27, a heater is installed internally to both the rollers 35 and 36 to heat the rollers 35 and 36.

—More Specific Description of the Fixing Apparatus 27—

Figure 2:
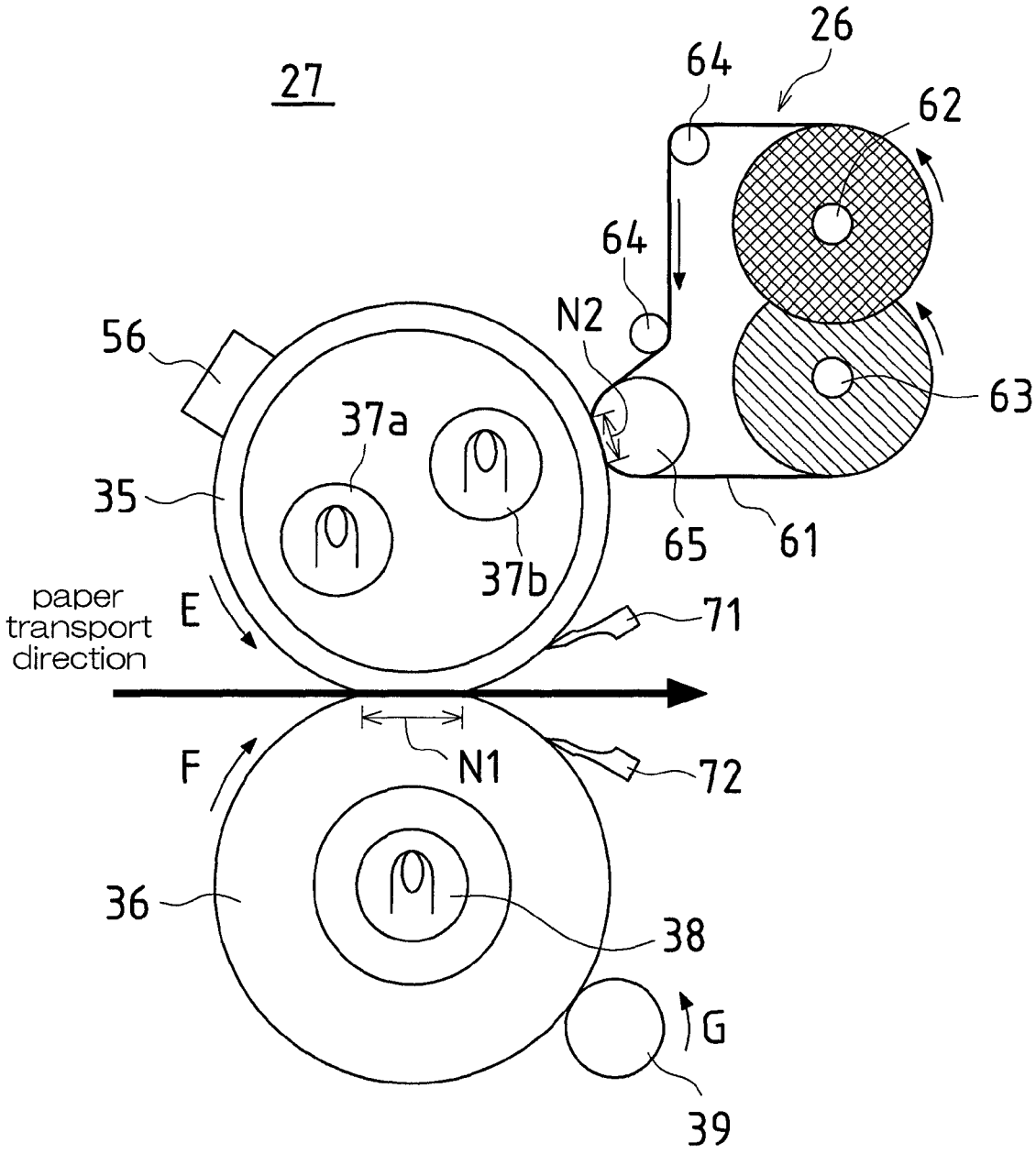
FIG. 2 is a cross-sectional view that schematically illustrates a fixing apparatus as viewed laterally.

FIG. 2 is a cross-sectional view that schematically illustrates the fixing apparatus 27 as viewed laterally. The fixing apparatus 27 is provided with the hot roller 35, the pressure roller 36, the cleaning unit 26 for removing toner that has adhered to the surface of the hot roller 35, a metal roller 39 for removing toner (smeared toner) that has adhered to the surface of the pressure roller 36, and paper separation claws 71 and 72 respectively provided at surfaces of the hot roller 35 and the pressure roller 36.

The cleaning unit 26 is provided with a feed-out roller 62 onto which is wound a web sheet 61 constituted by a thin cloth (approximately 40 μm thick) impregnated with an oil (silicone oil), a take-up roller 63 to which the leading edge of the web sheet 61 is connected, a plurality of tension rollers 64 that apply tension to the web sheet 61 along the transport path of the web sheet 61 from the feed-out roller 62 to the take-up roller 63, and a pressing roller 65 that presses the web sheet 61 onto the hot roller 35 between the feed-out roller 62 and the take-up roller 63, and residual toner sticking to the surface of the hot roller 35 is wiped off and removed by the web sheet 61 being pressed against the surface of the hot roller 35 by the pressing roller 65.

The web sheet 61 is pressed against the surface of the hot roller 35 by the pressing roller 65 at a nip region N2 between the pressing roller 65 and the hot roller 35. A portion of the web sheet 61 at the nip region N2 becomes smeared by residual toner on the surface of the hot roller 35, and when removal of residual toner by this portion of the web sheet 61 becomes difficult, the feed-out roller 62 and the take-up roller 63 are rotated by a fixed amount so that the web sheet 61 is fed out from the feed-out roller 62 to the take-up roller 63 by a fixed amount, thereby renewing the portion of the web sheet 61 at the nip region and making it possible to remove residual toner with this new portion of the web sheet 61. In this way, the portion of the web sheet 61 at the nip region N2 is renewed, and removal of residual toner by the new portion of the web sheet 61 is made possible.

Furthermore, when for each time a fixed amount of toner is consumed and it is deemed that removal of residual toner by the portion of the web sheet 61 of the nip region N2 has become difficult, the feed-out roller 62 and the take-up roller 63 are rotated by a fixed amount to renew the portion of the web sheet 61 at the nip region N2. Consequently, the feed-out roller 62 and the take-up roller 63 are intermittently rotationally driven.

The metal roller 39 is arranged in a manner contacting an outer circumferential surface of the pressure roller 36 so as to be idly rotated. A multitude of indentations are formed on the surface of the metal roller 39 such that toner that has adhered to the surface of the pressure roller 36 (smeared toner) is collected in these indentations.

The paper separation claws 71 and 72 are arranged on a downstream side from a fixing nip portion N1 in the rotation direction of the rollers 35 and 36. The paper separation claws 71 and 72 are swingably or elastically supported near their base ends, and the leading edge side of the paper separation claws 71 and 72 apply a biasing force due to their elastic members against the rollers 35 and 36 respectively such that the leading edge vicinity of each of the paper separation claws 71 and 72 presses lightly against the surface of the rollers 35 and 36 respectively. When a recording paper is wound onto either of the rollers 35 and 36, the leading edge of the recording paper is separated by the leading edge of either of the paper separation claws 71 and 72 and the recording paper is peeled off from the roller surface. In this way, jamming of the recording paper is prevented.

The rollers 35 and 36 press against each other with a predetermined pressing force (for example, 600 N) and the fixing nip portion N1 is formed between these. The length of the fixing nip portion N1 (the length along the rotation direction of the rollers 35 and 36) is set to 9 mm for example. The rollers 35 and 36 rotate while being heated to a prescribed fixing temperature (for example 180° C.) and a toner image on a recording paper that passes through the fixing nip portion N1 is thermally melted.

The hot roller 35 is a roller having a three-layer structure in which an elastic layer is provided on an outer surface of its core and a mold release layer is formed on an outer surface of the elastic layer. A metal such as iron, stainless steel, aluminum, or copper for example, or an alloy of these or the like, is used for the core. Furthermore, a silicone rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

Two halogen heaters 37*a* and 37*b*, which are heat sources for heating the hot roller 35, are provided inside the hot roller 35 (inside the core).

Like the hot roller 35, the pressure roller 36 is also a roller having a three-layer structure that is constituted by a core of a metal such as iron, stainless steel, aluminum, or copper or an alloy of any of these, an elastic layer of a silicone rubber or the like on a surface of the core, and further still a mold release layer thereon of PFA or PTFE or the like. And a halogen heater 38 for heating the pressure roller 36 is also provided inside the pressure roller 36 (inside the core).

Furthermore, a thermistor 56, which is a temperature detection means, is arranged near the surface of the hot roller 35 and the surface temperature of the hot roller 35 is detected by the thermistor 56.

Here, the shaft of the hot roller 35 is rotationally driven by a motor and a power transmission mechanism or the like (not shown in drawings) and rotates in a direction indicated by arrow E. Due to being pressed against the hot roller 35, the pressure roller 36 is idly rotated in a direction indicated by arrow F. Due to being pressed against the pressure roller 36, the metal roller 39 is idly rotated in a direction indicated by arrow G.

Furthermore, the halogen heaters 37*a*, 37*b*, and 38 of the hot roller 35 and the pressure roller 36 are controlled based on the surface temperature of the hot roller 35 detected by the thermistor 56 so as to regulate the surface temperatures of the hot roller 35 and the pressure roller 36. In this way, the surface temperatures of the rollers 35 and 36 are controlled appropriately and the toner image on the recording paper can be fixed reliably.

In the fixing apparatus 27 of the above-described configuration, the recording paper that has wound onto the hot roller 35 is forcibly peeled off by the paper separation claw 71, but at the time the paper is forcibly peeled off by the paper separation claw 71 the melted toner that is adhering onto the hot roller 35 adheres to the paper separation claw 71. The melted toner adhering to the paper separation claw 71, when a certain amount of it has accumulated on the paper separation claw 71, separates from the paper separation claw 71, moves in reverse to the hot roller 35, reaches the cleaning unit 26, and is collected by the cleaning unit 26.

Furthermore, when the recording paper passes through the fixing nip portion N1 in a case of double sided printing, since there is a toner image on the pressure roller 36 side also, toner in a half-melted state adheres to the pressure roller 36 side also due to the surface temperature of the pressure roller 36 and the pressure applied to the fixing nip portion N1 when the recording paper passes through the fixing nip portion N1 in this state. When this adhered toner reaches the metal roller 39, it is collected in the indentations of the metal roller 39.

However, when the speed of the image forming apparatus has been increased and the print processing sheet number becomes large volume, the amount of melted toner that separates from the paper separation claw 71 also becomes large volume, and there is a problem that it escapes past the web sheet 61 of the cleaning unit 26. Consequently, not only does the cleaning of the hot roller 35 become incomplete, toner also moves to the pressure roller 36 at the fixing nip portion N1 such that the amount of melted toner collected by the metal roller 39 also increases. And when toner can no longer be collected by the metal roller 39, this is a cause of back side smearing of the recording paper that is transported in for printing to be carried out next. Furthermore, since a leading edge portion 72*a* of the paper separation claw 72 is always in contact with the surface of the pressure roller 36 during image forming operations, toner that has adhered to the surface of the pressure roller 36 is scraped with the leading edge portion 72*a* of the paper separation claw 72 so that residual toner adheres to the leading edge portion 72*a*.

Figure 3A:
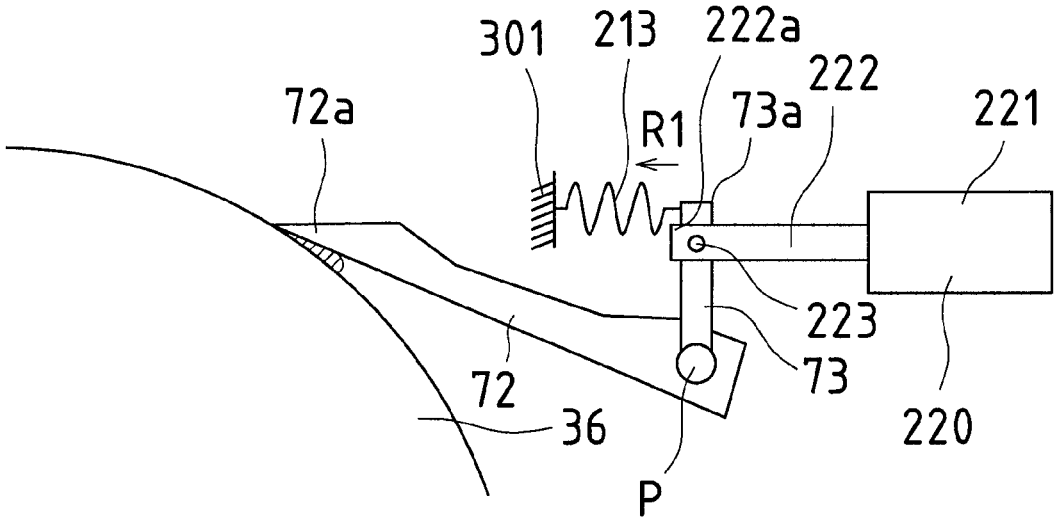
FIG. 3(*a*) and FIG. 3(*b*) are explanatory diagrams that schematically show areas of a paper separation claw and a drive source thereof provided at a pressure roller.
Figure 3B:
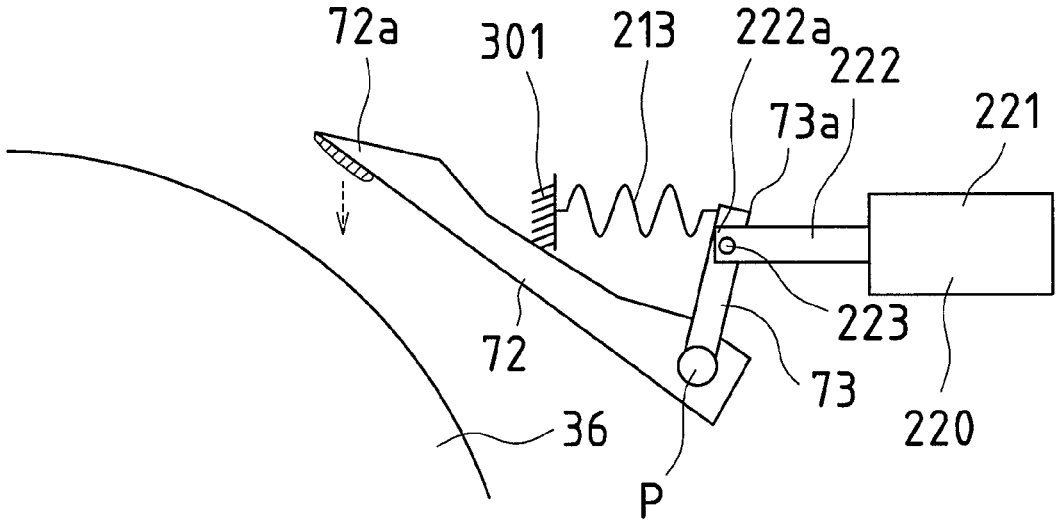

FIG. 3(*a*) and FIG. 3(*b*) are explanatory diagrams that schematically show areas of the paper separation claw 72 and a drive source 220 thereof provided at the pressure roller 36. FIG. 3(*a*) shows a state in which the paper separation claw 72 is in contact with the surface of the pressure roller 36 with the drive source 220 in a non-energized state (OFF state) and FIG. 3(*b*) shows a state in which the paper separation claw 72 is apart from the surface of the pressure roller 36 with the drive source 220 in an energized state (ON state).

That is, the paper separation claw 72 is rotatably provided so as to rotate around a support shaft P along an axial direction (direction perpendicular to the paper surface) of the pressure roller 36; and the leading edge portion 72*a* on the opposite end from the support shaft P is in contact with the surface of the pressure roller 36. The support shaft P is secured to an unshown frame of the fixing apparatus 27. The leading edge portion 72*a* of the paper separation claw 72 is formed having a sharp cross-sectional wedge shape and functions so that the leading edge of a recording paper that is closely adhering to the surface of the pressure roller 36 is swept up from the surface of the pressure roller 36. A rotating arm 73 that protrudes upwardly is integrally arranged with the paper separation claw 72 at a portion of the support shaft P of the paper separation claw 72. And one end portion of a biasing member 213 such as a wound spring is secured to a leading edge portion 73*a* of the rotating arm 73, and another end portion of the biasing member 213 is secured to a frame 301 of the fixing apparatus 27. The biasing member 213 is arranged in an extended state. That is, the rotating arm 73 is always biased in an R1 direction shown in the diagram due to a contraction function of the biasing member 213 such that the leading edge portion 72*a* of the paper separation claw 72 is always in contact (pressing against) the surface of the pressure roller 36.

Furthermore, the drive source 220 is a drive mechanism that uses a solenoid, and is provided with a movable rod 222 capable of advancing and retreating such that it protrudes from a solenoid body 221 during the non-energized state (OFF state) and retreats inside the solenoid body 221 during the energized state (ON state). A leading edge engaging portion 222*a* of the movable rod 222 is rotatably engaged by a support pin 223 or the like near the leading edge portion 73*a* of the rotating arm 73. And during the non-energized state (OFF state), the movable rod 222 protrudes from the solenoid body 221 as shown in FIG. 3(*a*) so that, in cooperation with the biasing force of the biasing member 213, the leading edge portion 72*a* of the paper separation claw 72 contacts the surface of the pressure roller 36. On the other hand, during the energized state (ON state), the movable rod 222 opposes the biasing force of the biasing member 213 and retreats inside the solenoid body 221 as shown in FIG. 3(*b*) so that the leading edge portion 72*a* of the paper separation claw 72 separates from the surface of the pressure roller 36.

In other words, when a separation operation is carried out with respect to the pressure roller 36, the paper separation claw 72 separates from the surface of the pressure roller 36 due to the drive source 220 being turned on (ON), and on the other hand, when a contact operation is carried out with respect to the pressure roller 36, the paper separation claw 72 contacts the surface of the pressure roller 36 due to power to the drive source 220 being cut (OFF).

It should be noted that in the present embodiment the drive source 220 is configured as a drive mechanism using a solenoid, but it is also possible to use a commonly known drive source such as a stepping motor.

Figure 4:
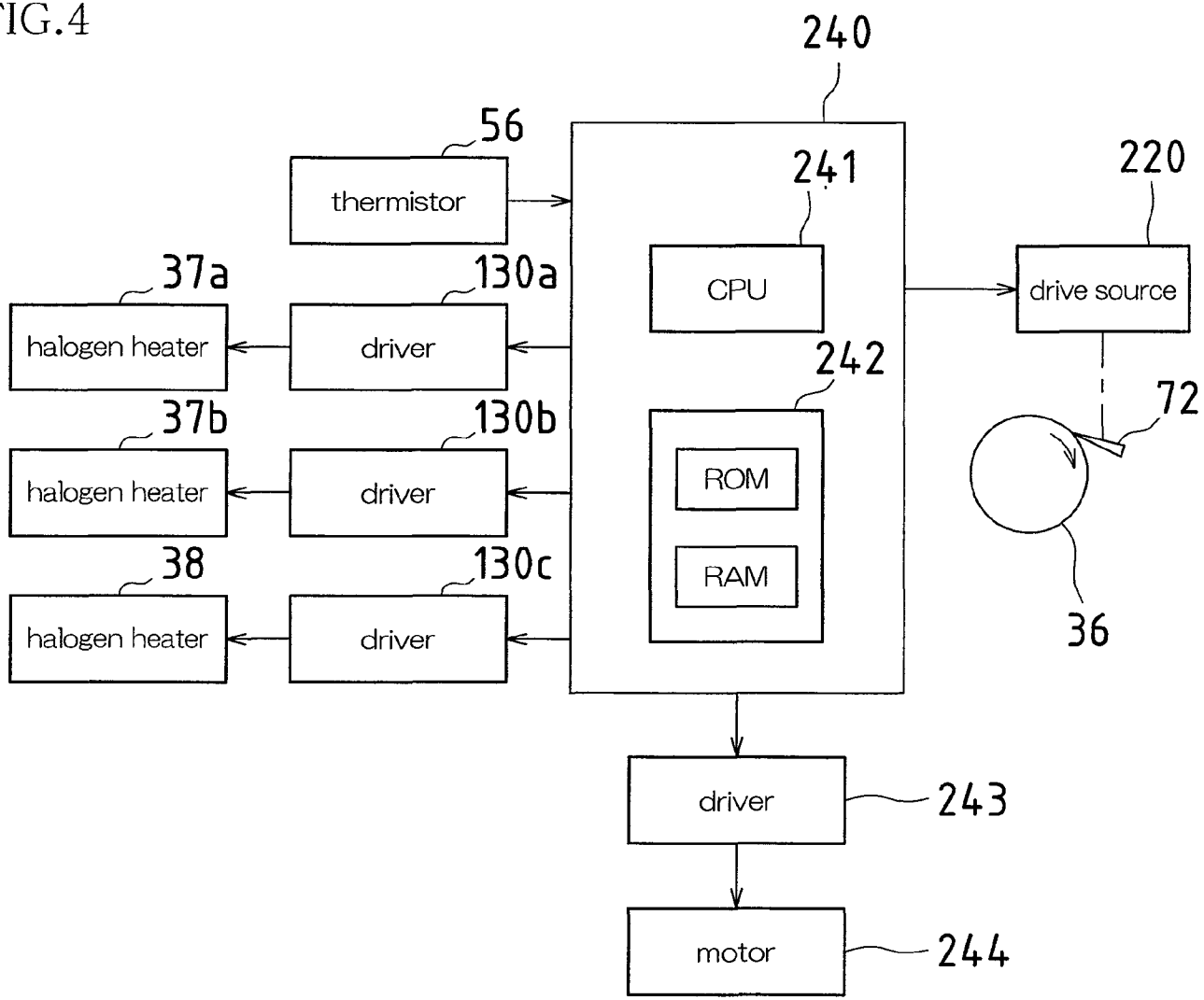
FIG. 4 is an outline block diagram showing a system configuration of a control portion in the image forming apparatus shown in FIG. 1.

FIG. 4 is an outline block diagram showing a system configuration of a control portion 240 that performs overall control of the image forming apparatus 100 shown in FIG. 1. Note however that FIG. 4 shows only blocks that are related to the present invention.

The control portion 240 is provided with a CPU (central processing unit) 241 and a storage portion 242. The storage portion 242 stores various control programs and necessary functions, and includes a ROM (read only memory) and a RAM (random access memory).

The control portion 240 is configured such that various control programs are read out from the storage portion 242 by the CPU 241 and control of image forming processes is carried out by executing the control programs that have been read out.

Furthermore, the drive source 220 for performing separation and contact control of the paper separation claw 72 is electrically connected to an output system of the control portion 240, and energization control is performed by the control portion 240. Furthermore, a motor 244 that is driven via a driver 243 is a drive source that rotationally drives the hot roller 35 and the pressure roller 36.

Furthermore, the output of the thermistor 56, which is a temperature detection means for carrying out surface temperature control of the hot roller 35 and the pressure roller 36, is connected to the control portion 240, and the halogen heaters 37*a*, 37*b*, and 38 are connected to the control portion 240 via drivers 130*a* to 130*c* respectively. The control portion 240 separately controls each of the drivers 130*a* to 130*c* to separately control ON and OFF of electricity to the halogen heaters 37*a*, 37*b*, and 38. That is, electricity to the halogen heaters 37*a*, 37*b*, and 38 can be controlled independently. Furthermore, in the present embodiment, the thermistor 56, which is a temperature detection means, is provided only for the hot roller 35, and the control portion 240 is configured to also perform control of ON and OFF of electricity to the halogen heater 38 inside the pressure roller 36 based on the detected temperature of the thermistor 56. In this way, by using the detection results of the thermistor 56, which detects the temperature of the surface of the hot roller 35, for controlling the surface temperature of the pressure roller 36, the number of components can be reduced and device miniaturization becomes possible.

Figures 5A, 5B, 5C:
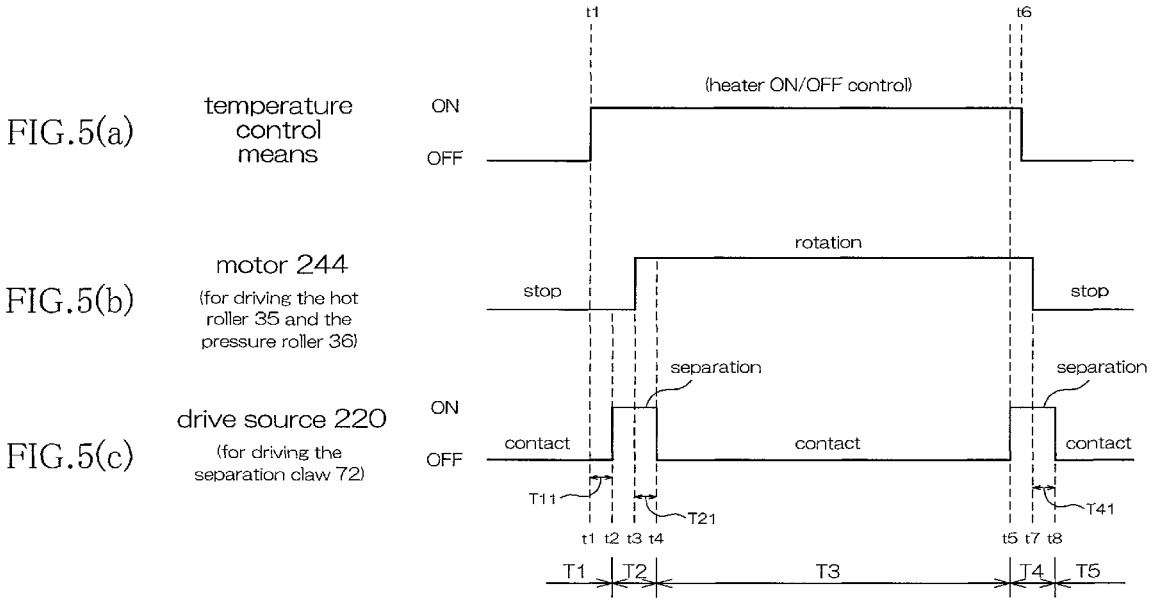
FIG. 5(*a*) to FIG. 5(*c*) are timing charts showing rotation periods of a hot roller and a pressure roller in the fixing apparatus and timings of energized and non-energized states of the drive source.

FIG. 5(*a*) to FIG. 5(*c*) are timing charts showing rotation periods of the hot roller 35 and the pressure roller 36 in the fixing apparatus 27 and timings of energized and non-energized states of the drive source 220.

It should be noted in regard to the timing chart of the temperature control means shown in FIG. 5(*a*) that "ON" shows a state in which surface temperature control is being executed on the hot roller 35 and the pressure roller 36 using ON-OFF control of the halogen heaters 37*a*, 37*b*, and 38 based on the detected temperature of the thermistor 56, and "OFF" shows a state in which this temperature control is stopped.

Furthermore, in the timing chart shown in FIG. 5(*b*), "rotation" indicates that the hot roller 35 and the pressure roller 36 are in a rotating state due to the drive force of the drive source such as the motor 244, and "stop" indicates a state in which the hot roller 35 and the pressure roller 36 are stopped.

Furthermore, in the timing chart of energization control to the drive source 220 shown in FIG. 5(*c*), "ON" indicates that the drive source 220 is in an energized state (a state in which the paper separation claw 72 is separated from the pressure roller 36) and "OFF" indicates that the drive source 220 is in a non-energized state (a state in which the paper separation claw 72 is in contact with the surface of the pressure roller 36).

As shown in FIG. 5(*a*) to FIG. 5(*c*), the paper separation claw 72 is separated from the surface of the pressure roller 36 by the drive source 220 being turned ON at a time t2 before commencement of rotation of the pressure roller 36, and the paper separation claw 72 is made to contact the surface of the pressure roller 36 by the drive source 220 being turned OFF after commencement of rotation (a time t4) of the pressure roller 36. Furthermore, the paper separation claw 72 is separated from the surface of the pressure roller 36 by the drive source 220 being turned ON again before stopping of rotation (a time t5) of the pressure roller 36 after an image forming operation of a single job is finished, and the paper separation claw 72 is made to contact the surface of the pressure roller 36 by the drive source 220 being turned OFF again after stopping of rotation (a time t8) of the pressure roller 36.

In this way, in the present embodiment, the drive source 220 is in an ON state only during a period T2 before and after commencement of rotation of the pressure roller 36 and a period T4 before and after stopping of rotation, and the drive source 220 is in an OFF state during periods T1, T3, and T5 other than this, and therefore the energization time of the drive source 220 during an image forming operation (during fixing apparatus operation) can be shortened. In this way, the heat produced by the drive source 220 can be suppressed and reductions in the performance of the drive source 220 and reductions in its life can be effectively prevented.

Figure 6:
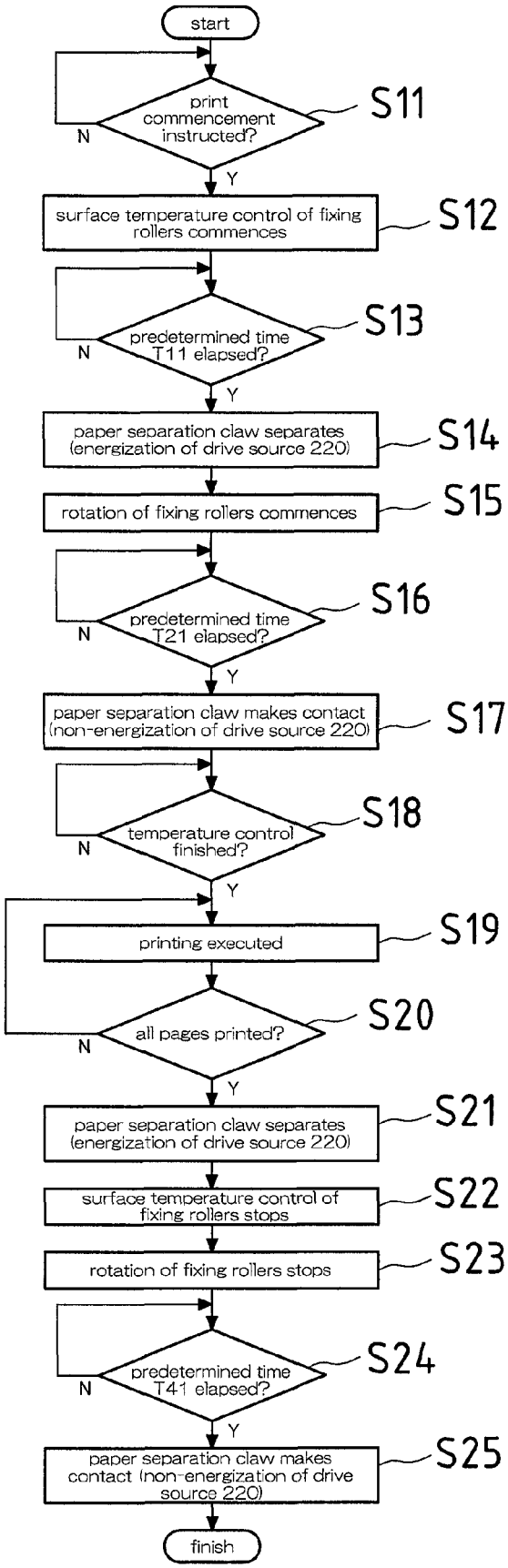
FIG. 6 is a flowchart showing one example of energization control to the drive source for performing separation and contact control of the paper separation claw in the image forming apparatus according to the present invention.

Next, description is given regarding one example energization control to the drive source 220 for performing separation and contact control of the paper separation claw 72 in the image forming apparatus 100 configured as described above with reference to a flowchart shown in FIG. 6 and the timing charts shown in FIG. 5(*a*) to FIG. 5(*c*).

When print commencement in the image forming apparatus 100 is instructed at a time t1 by a pressing operation of an unshown start button or reception of print data from a PC (personal computer) as a trigger (when determined "Yes" at S11), the control portion 240 individually commences energization to the halogen heaters 37*a*, 37*b*, and 38 of the fixing apparatus 27 by performing drive control on the drivers 130*a* to 130*c*, so that surface temperature control of the hot roller 35 and the pressure roller 36 commences (S12) based on the detected surface temperature of the thermistor 56. The temperature control at this time is ON-OFF control of the halogen heaters 37*a*, 37*b*, and 38.

In this state there is a standby (S13) during a predetermined time T11 until the surface temperature of the pressure roller 36 rises to a certain extent. Then, when the predetermined time T11 elapses ("Yes" at S13) and the surface temperature of the pressure roller 36 rises, the residual toner adhering between the leading edge portion 72*a* of the paper separation claw 72 and the surface of the pressure roller 36 is heated by the heat of the pressure roller 36, thereby reducing its adhesion to the pressure roller 36. For this reason, the control portion 240 energizes the drive source 220 at this timing (time t2) so that the paper separation claw 72 separates from the surface of the pressure roller 36 (S14). That is, the paper separation claw 72 undergoes a rotation operation from the state shown in FIG. 3(*a*) to the state shown in FIG. 3(*b*). Due to this, the residual toner adhering between the leading edge portion 72*a* of the paper separation claw 72 and the surface of the pressure roller 36 separates from the surface of the pressure roller 36 while adhering to the paper separation claw 72 side since the adhesion on the side of the surface of the pressure roller 36 is weaker than the adhesion on the side, of the leading edge portion 72*a* of the paper separation claw 72. Then, due to vibration of the paper separation claw 72 at the time of separation, a major portion of the residual toner adhering to the paper separation claw 72 drops due to the separation operation.

After this, the control portion 240 commences energization to the motor 244 at a time t3 so that rotation of the hot roller 35 and the pressure roller 36 commences (S15). Then, the control portion 240 turns energization to the drive source 220 OFF after waiting (S16) for a predetermined time T21 to elapse as a time until rotation of the pressure roller 36 stabilizes so that the paper separation claw 72 is caused to contact the surface of the pressure roller 36 again (S17). That is, the paper separation claw 72 undergoes a rotation operation from the state shown in FIG. 3(*b*) to the state shown in FIG. 3(*a*). Due to the vibration of contact and a rubbing effect of rotation of the pressure roller 36 at this time, the residual toner remaining on the leading edge portion 72*a* of the paper separation claw 72 is scraped off so as to drop. In this way, the paper separation claw 72 returns to its predetermined position for image forming operations.

After this, when the surface temperature of the hot roller 35 reaches a predetermined temperature (when determined "Yes" at S18), printing is executed (S19) based on image data transferred from an unshown PC (personal computer) or the like or based on image data of an original that has been read by the image reading portion 102, and this is repeated (S20) until printing of all the pages of the image data is finished. Then, when printing of all the pages is finished (when determined "Yes" at S20), energization to the drive source 220 is turned ON at a time t5 so that the paper separation claw 72 again separates (S21). That is, the paper separation claw 72 undergoes a rotation operation from the state shown in FIG. 3(*a*) to the state shown in FIG. 3(*b*). Before rotation of the pressure roller 36 stops (time t7), the surface temperature of the pressure roller 36 is comparatively high such that the adhesion of toner to the surface of the pressure roller 36 is weak. Consequently, residual toner can be made to adhere to the side of the leading edge portion 72*a* of the paper separation claw 72 by separating the paper separation claw 72 in this state. Furthermore, by separating the paper separation claw 72 from the surface of the pressure roller 36, thermal conduction to the paper separation claw 72 is interrupted, and therefore toner adhering to the paper separation claw 72 can be cooled (natural cooling).

After this, energization to the halogen heaters 37*a*, 37*b*, and 38 of the fixing apparatus 27 is turned OFF at a time t6 so that temperature control stops (S22). Next, driving of the motor 244 stops at a time t7 so that rotation of the hot roller 35 and the pressure roller 36 stops (S23). Then, after waiting for a predetermined time T41 to elapse, which is a time required until the surface temperature of the pressure roller 36 drops sufficiently and a time required until the rotation speed of pressure roller 36 drops sufficiently (or stops) (when determined "Yes" at S24), the control portion 240 turns OFF the energization to the drive source 220 at a time t8, thereby causing the paper separation claw 72 to contact the surface of the pressure roller 36 again (S25). That is, the paper separation claw 72 undergoes a rotation operation from the state shown in FIG. 3(*b*) to the state shown in FIG. 3(*a*). The paper separation claw 72 is caused to make contact again.

At this time, although there are times when toner adhering to the leading edge portion 72*a* of the paper separation claw 72 drops due to the vibration caused by contact, in this case no effect of scraping off of the toner can be expected since the rotation of the pressure roller 36 is also stopped. However, since residual toner adhering to the leading edge portion 72*a* of the paper separation claw 72 can be prevented from re-adhering to the pressure roller 36 even when the paper separation claw 72 is made to contact the pressure roller 36 again after rotation of the pressure roller 36 has stopped, it becomes possible to make this residual toner adhere to the paper separation claw 72 when the paper separation claw 72 separates at the time of the next image forming operation.

It should be noted that in the above-described embodiment, description was given regarding separation and contact control of the paper separation claw 72 for the paper separation claw 72 on the pressure roller 36 side, but it is also possible to perform separation and contact control for the paper separation claw 71 on the hot roller 35 side in a same manner.

Furthermore, in the above-described embodiment, the halogen heater 38 is provided inside the pressure roller 36 side, and although description is given of a configuration in which temperature control for the surface of the pressure roller 36 is carried out by turning ON and OFF the halogen heater 38, the present invention can also be applied to a fixing apparatus of a configuration not provided with the halogen heater 38 on the pressure roller 36 side (that is, not provided with a direct heating means). That is, in a case where the halogen heater 38 is not provided on the pressure roller 36 side, the temperature control for the surface of the pressure roller 36 is entirely carried out using thermal conduction through the fixing nip portion N1 by controlling the ON and OFF of the halogen heaters 37*a* and 37*b* provided for the hot roller 35, but in this case also, the relationship between the surface temperature of the pressure roller 36 and the temperature of the paper separation claw 72 (the temperature due to thermal conduction) is essentially identical to the case where the halogen heater 38 is provided for the pressure roller 36. Consequently, the present invention can also be applied to a fixing apparatus that is not provided with a heating means on the pressure roller 36 side.

The present invention can be embodied and practiced in other different forms without departing from the purport and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus, comprising:

a pair of fixing rollers, a fixing roller drive source for rotationally driving the fixing rollers, a paper separation member arranged so as to be capable of contacting and separating from a surface of one of the fixing rollers in order to separate from the fixing roller a paper transported along with rotation of the fixing roller while contacting the surface of the fixing roller, a separation member drive source for driving the paper separation member, and a control portion for controlling a fixing process, wherein the control portion performs control so that the paper separation member separates from a surface of the fixing roller by performing drive control on the separation member drive source before a change in a drive state of the fixing rollers by the fixing roller drive source, and the paper separation member contacts the surface of the fixing roller by performing drive control on the separation member drive source after a change in the drive state of the fixing rollers by the fixing roller drive source, and further comprising:

a temperature detection portion for detecting a temperature of the surface of the fixing roller, and a heating portion for heating the fixing roller, wherein the control portion executes temperature control on the fixing roller using the heating portion based on a temperature detected by the temperature detection portion in a period in which the paper separation member is in contact with the fixing roller, and carries out separation control of the paper separation member during execution of this temperature control, and the control portion causes the paper separation member to separate from the surface of the fixing roller before stopping of rotation of the fixing roller, and causes the paper separation member to contact the surface of the fixing roller after stopping of rotation of the fixing roller.

2. The fixing apparatus according to claim 1, wherein the control portion causes the paper separation member to separate from the surface of the fixing roller before commencement of rotation of the fixing roller, and causes the paper separation member to contact the surface of the fixing roller after commencement of rotation of the fixing roller.

3. The fixing apparatus according to claim 1, wherein the pair of fixing rollers is constituted by a hot roller and a pressure roller, and the control portion performs separation and contact control on a paper separation member provided for the pressure roller.

4. The fixing apparatus according to claim 1, wherein the separation member drive source is configured so that the paper separation member is driven so as to separate from the surface of the fixing roller when in an energized state, and the paper separation member is driven so as to contact the surface of the fixing roller when in a non-energized state, and the control portion controls the separation member drive source to a non-energized state when the paper separation member is to be caused to contact the surface of the fixing roller, and controls the separation member drive source to an energized state when the paper separation member is to be caused to separate from the surface of the fixing roller.

5. The fixing apparatus according to claim 1, wherein the paper separation member is a paper separation claw and a portion of the paper separation claw that contacts the surface of the fixing roller is formed in a sharp shape.

6. The fixing apparatus according to claim 1, wherein the heating portion is provided inside a pressure roller, which is one of the fixing rollers.

7. The fixing apparatus according to claim 6, wherein the temperature detection portion detects a surface temperature of a hot roller which is another fixing roller, and the control portion controls energization of the heating portion inside the pressure roller based on a detection result of the temperature detection portion.

8. An image forming apparatus equipped with a fixing apparatus according to claim 1.

9. The fixing apparatus according to claim 2, wherein the pair of fixing rollers is constituted by a hot roller and a pressure roller, and the control portion performs separation and contact control on a paper separation member provided for the pressure roller.

10. The fixing apparatus according to claim 2, wherein the paper separation member is a paper separation claw and a portion of the paper separation claw that contacts the surface of the fixing roller is formed in a sharp shape.

11. An image forming apparatus equipped with a fixing apparatus according to claim 2.

* * * * *